US009342038B2

(12) United States Patent
Aoi

(10) Patent No.: US 9,342,038 B2
(45) Date of Patent: May 17, 2016

(54) IMAGE FORMING APPARATUS WITH SHUTTER FOR COVERING A SWITCH OPENING

(71) Applicant: BROTHER KOGYO KABUSHIKI KAISHA, Nagoya-shi, Aichi-ken (JP)

(72) Inventor: Yosuke Aoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/629,631

(22) Filed: Feb. 24, 2015

(65) Prior Publication Data

US 2015/0248105 A1 Sep. 3, 2015

(30) Foreign Application Priority Data

Feb. 28, 2014 (JP) ..... 2014-039058

(51) Int. Cl.

| | |
|---|---|
| ***G03G 15/00*** | (2006.01) |
| ***G03G 21/16*** | (2006.01) |
| ***H01H 9/22*** | (2006.01) |
| ***H01H 21/06*** | (2006.01) |

(52) U.S. Cl.

CPC ..... *G03G 21/1633* (2013.01); *H01H 9/22* (2013.01); *H01H 21/06* (2013.01); *G03G 2221/169* (2013.01)

(58) Field of Classification Search

CPC ..... G03G 21/1633; G03G 2221/1687; G03G 2221/169; G03G 21/1623; H01H 9/22; H01H 21/06

USPC ..... 399/107, 110; 200/50.12

See application file for complete search history.

(56) References Cited

U.S. PATENT DOCUMENTS

| | | | | | |
|---|---|---|---|---|---|
| 3,898,412 | A * | 8/1975 | Robinson | H05B 6/6417 126/197 |
| 4,908,659 | A * | 3/1990 | Ishii | G03G 21/1647 292/128 |
| 4,978,817 | A * | 12/1990 | Honda | G03G 15/80 200/50.1 |
| 8,084,702 | B2 | 12/2011 | Kawarago | |
| 2012/0012445 | A1 * | 1/2012 | Ohta | G03G 21/1633 200/50.12 |

FOREIGN PATENT DOCUMENTS

| | | | |
|---|---|---|---|
| JP | 61-229294 | A * | 10/1986 |
| JP | 63-267958 | A * | 11/1988 |
| JP | 02-151880 | A * | 6/1990 |
| JP | 2003-005592 | A | 1/2003 |
| JP | 2005-197168 | A * | 7/2005 |
| JP | 2006-053475 | A * | 2/2006 |
| JP | 2010-054592 | A | 3/2010 |
| KR | 2007-032539 | A * | 3/2007 |

* cited by examiner

*Primary Examiner* — Robert Beatty
(74) *Attorney, Agent, or Firm* — Merchant & Gould P.C.

(57) ABSTRACT

An image forming apparatus includes a casing having a first opening and a second opening. The first and second openings each extend between an interior of the casing and an exterior of the casing. A cover has a close position in which the cover covers the first opening and the second opening, and an open position in which cover does not cover the first opening and the second opening. A shutter has a shielding position in which the shutter covers the second opening, and a retracted position. The shutter is operably connected to the cover so as to move between the shielding position and the retracted position in response to movement of the cover. A protrusion extends from the cover, and the protrusion extends through the second opening when the cover is in the close position and the shutter is in the retracted position.

19 Claims, 8 Drawing Sheets

IMAGE FORMING APPARATUS WITH SHUTTER FOR COVERING A SWITCH OPENING

CROSS-REFERENCE TO RELATED APPLICATION

This application claims priority from Japanese Patent Application No. 2014-039058 filed on Feb. 28, 2014, the content of which is incorporated herein by reference in its entirety.

FIELD OF DISCLOSURE

The disclosure relates to an image forming apparatus including an interlock switch.

BACKGROUND

In a known image forming apparatus, an interlock switch is disposed in a casing. The interlock switch is configured to be switched between on and off by opening and closing an opening-and-closing member. More specifically, the opening-and-closing member is provided with a protruding pressing portion. As the opening-and-closing member is closed, the pressing portion is inserted into a hole provided in the casing and presses the interlock switch.

The image forming apparatus includes a restricting member having an opening smaller than the hole of the casing. The restricting member is disposed between the hole of the casing and the interlock switch to move in a direction intersecting a direction in which the pressing portion passes through the hole of the casing. In the image forming apparatus, the interlock switch may be pressed as the pressing portion of the opening-and-closing member inserted into the hole of the casing passes through the opening of the restricting member while moving the restricting member. Thus, malfunction of the image forming apparatus caused by a user pressing the interlock switch with his/her finger as the opening-and-closing member is open, may be prevented. However, the interlock switch is able to be pressed by inserting, for example, a rod, into the hole when the opening-and-closing member is open.

SUMMARY

The disclosure relates to an image forming apparatus that may reduce or prevent an interlock switch from being pressed when an opening-and-closing member is open. For example, an image forming apparatus in accordance with aspects of the disclosure includes a casing having a first opening and a second opening. The first and second openings each extend between an interior of the casing and an exterior of the casing. A cover has a close position in which the cover covers the first opening and the second opening, and an open position in which cover does not cover the first opening and the second opening. A shutter has a shielding position in which the shutter covers the second opening, and a retracted position. The shutter is operably connected to the cover so as to move between the shielding position and the retracted position in response to movement of the cover. A protrusion extends from the cover, and the protrusion extends through the second opening when the cover is in the close position and the shutter is in the retracted position.

DETAILED DESCRIPTION

[First Illustrative Embodiment]

A first illustrative embodiments will be described with reference to the accompanying drawings. First, overall structures of an image forming apparatus, such as a color printer 1, and then further features of the disclosure will be described.

Figure 1:
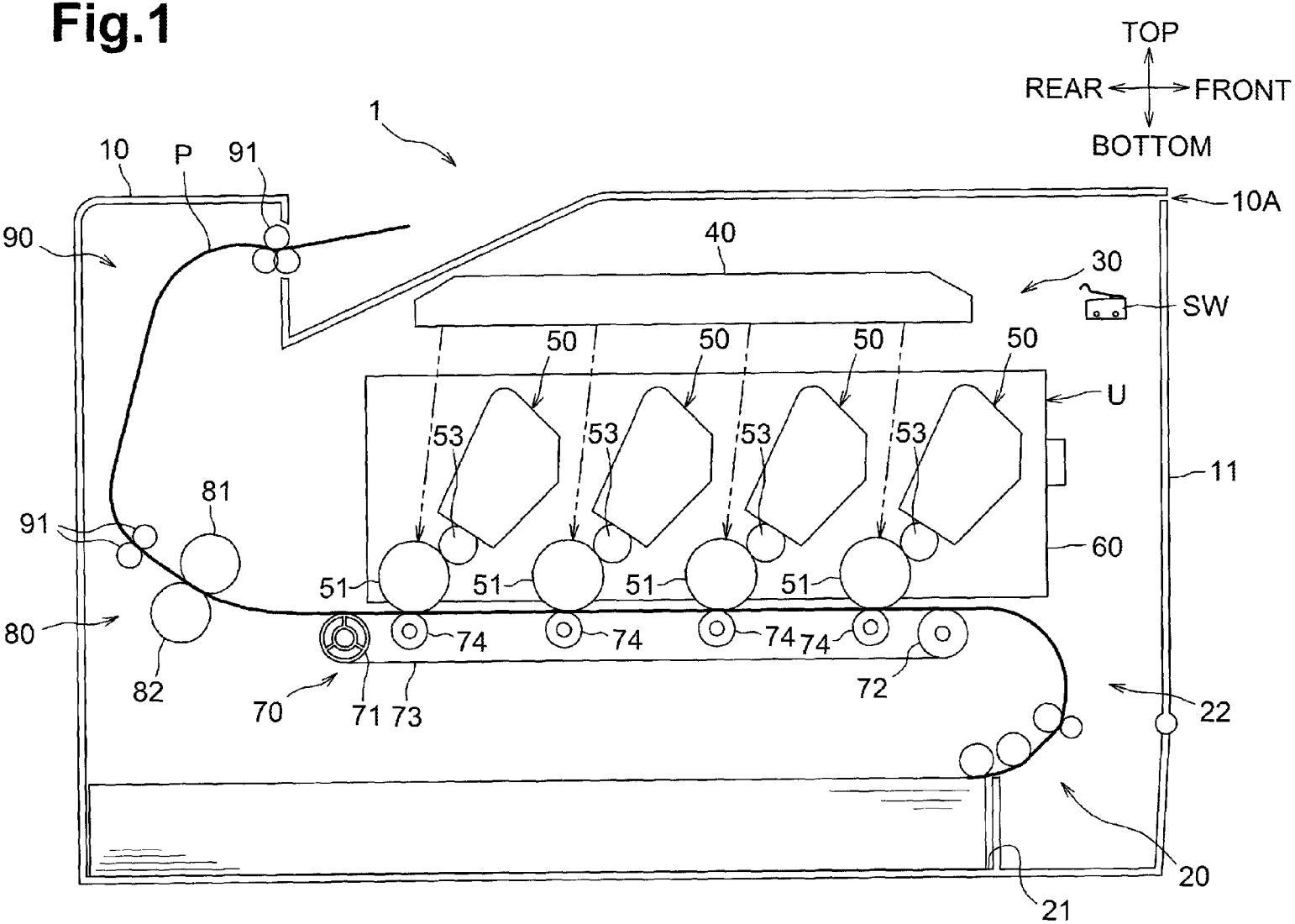
FIG. 1 is a cross-sectional view of a color printer in a first illustrative embodiment according to one or more aspects of the disclosure.

Hereinafter, description will be made with reference to directions that are defined in conjunction with an orientation in which a user uses the color printer 1. More specifically, right and left sides of FIG. 1 are defined as front/forward and rear/back sides, respectively. The front and back sides of the sheet of FIG. 1 are defined as right and left sides, respectively. The top-bottom direction in FIG. 1 is defined as the vertical direction.

As depicted in FIG. 1, the color printer 1 includes, in a casing 10, a sheet feed unit 20 configured to feed a sheet P, an image forming unit 30 configured to form an image on the fed sheet P, and a discharge unit 90 configured to discharge the sheet P having an image formed thereon.

The casing 10 has a first opening, e.g., an insertion opening 10A, formed at a front surface of the casing 10. The casing 10 includes an opening-and-closing member, e.g., a front cover 11, that has a close position in which the cover 11 covers the insertion opening 10A and an open position in which the insertion opening 10A is open. In the illustrated example, the cover 11 is configured to pivotally move about a lower end portion of the casing 10. The pivotal movement of the front cover 11 opens and closes the insertion opening 10A.

The sheet feed unit 20 includes a sheet tray 21 configured to accommodate one or more sheets P, and a sheet feeding mechanism 22 configured to feed the sheet P from the sheet tray 21 to the image forming unit 30.

The image forming unit 30 includes a scanner unit 40, a process unit U, a transfer unit 70, and a fixing unit 80.

The scanner unit 40 is disposed at an upper portion of the casing 10. The scanner unit 40 includes a laser emitting section (not depicted), a polygon mirror, lenses and reflecting mirrors. As depicted by dash-dot-dot lines in FIG. 1, the laser beam emitted from the scanner unit 40 scans at high speed across a surface of each photosensitive drum 51.

The process unit U is disposed in the casing 10. The process unit U includes four process cartridges 50 and a holder 60.

The process cartridges 50 are arranged above the sheet feed unit 20 along the front-rear direction. Each process cartridges 50 includes the photosensitive drum 51, a known charger (not depicted), a developing roller 53, and a toner accommodating chamber.

The holder 60 holds the four process cartridges 50 as one unit. The holder 60 is configured to be attached to and removed from the casing 10 via the insertion opening 10A that is opened as the front cover 11 is pivotally moved.

The transfer unit 70 is disposed between the sheet feed unit 20 and the four process cartridges 50. The transfer unit 70 includes a drive roller 71, a driven roller 72, a transfer belt 73, and transfer rollers 74.

The drive roller 71 and the driven roller 72 are arranged in parallel with and away from each other in the front-rear direction. An endless transfer belt 73 extends between the drive roller 71 and the driven roller 72. Four transfer rollers 74 are disposed opposite to the corresponding photosensitive drums 51 inside the transfer belt 73 to interpose the transfer belt 73 between the transfer rollers 74 and the photosensitive drums 51. A transfer bias is applied to the transfer rollers 74 under a constant current control during a transfer operation.

The fixing unit 80 is disposed more rearward than four process cartridges 50 and the transfer unit 70. The fixing unit 80 includes a heat roller 81 and a pressure roller 82 disposed opposite to the heat roller 81 and pressed against the heat roller 81.

In the image forming unit 30 as structured above, first, the surface of each photosensitive drum 51 is uniformly charged by the charger and then exposed by the scanner unit 40, so that the potential level of the exposed portion becomes lower than the remaining portion of the drum 51. Thus, an electrostatic latent image is formed on each photosensitive drum 51 based on image data. Thereafter, the toner accommodated in the toner accommodating chamber is supplied to the electrostatic latent image on the photosensitive drum 51 by the developing roller 53. Thus, a toner image is carried on the photosensitive drum 51.

Then, the sheet P fed onto the transfer belt 73 passes between each photosensitive drum 51 and the corresponding transfer roller 74, so that the toner image formed on each photosensitive drum 51 is transferred onto the sheet P. As the sheet P passes between the heat roller 81 and the pressure roller 82, the toner image is thermally fixed onto the sheet P.

The discharge unit 90 includes a plurality of feed rollers 91 configured to feed the sheet P. The sheet P having the toner image transferred and thermally fixed thereon is discharged outside the casing 10 by the feed rollers 91.

The color printer 1 includes an interlock switch SW disposed in the casing 10. The color printer 1 is configured to detect the opening and closing of the front cover 11 with the interlock switch SW.

Figure 2:
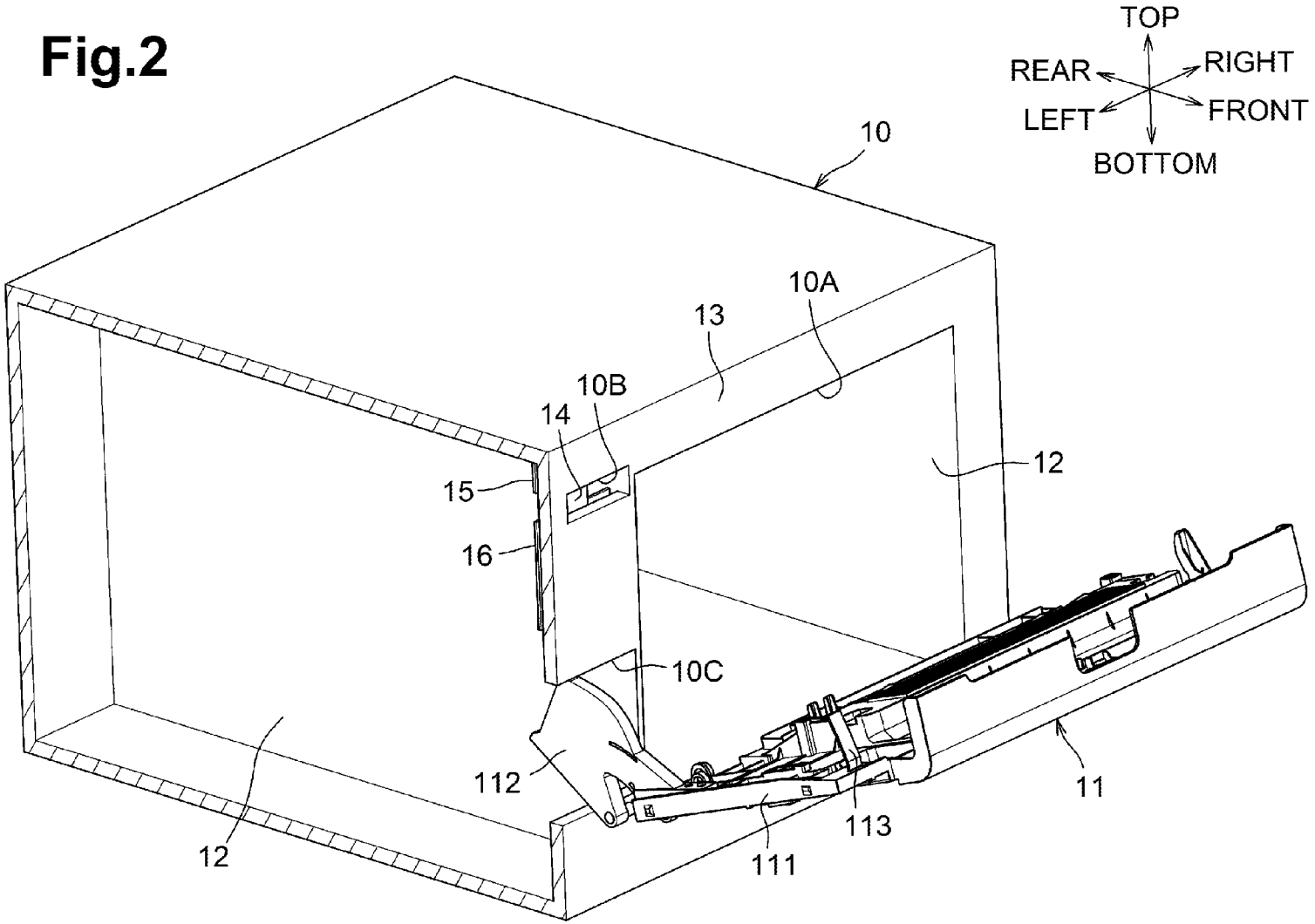
FIG. 2 is a perspective view of a casing with a front cover open.

More specifically, as depicted in FIG. 2, the casing 10 includes a frame, e.g., a side frame 12, disposed at each right and left side of the process unit U, and a front wall 13 having the insertion opening 10A formed thereon. A left end portion of the front wall 13 extends more outward in the left-right direction than the left side frame 12. The portion of the front wall 13 extending more outward in the left-right direction than the left side frame 12 has a second opening, e.g., a switch opening 10B, and an opening portion 10C.

The switch opening 10B is smaller than the insertion opening 10A. The switch opening 10B is formed to the left of the insertion opening 10A at an upper portion of the front wall 13. The opening portion 10C is formed below the switch opening 10B.

Figure 3B:
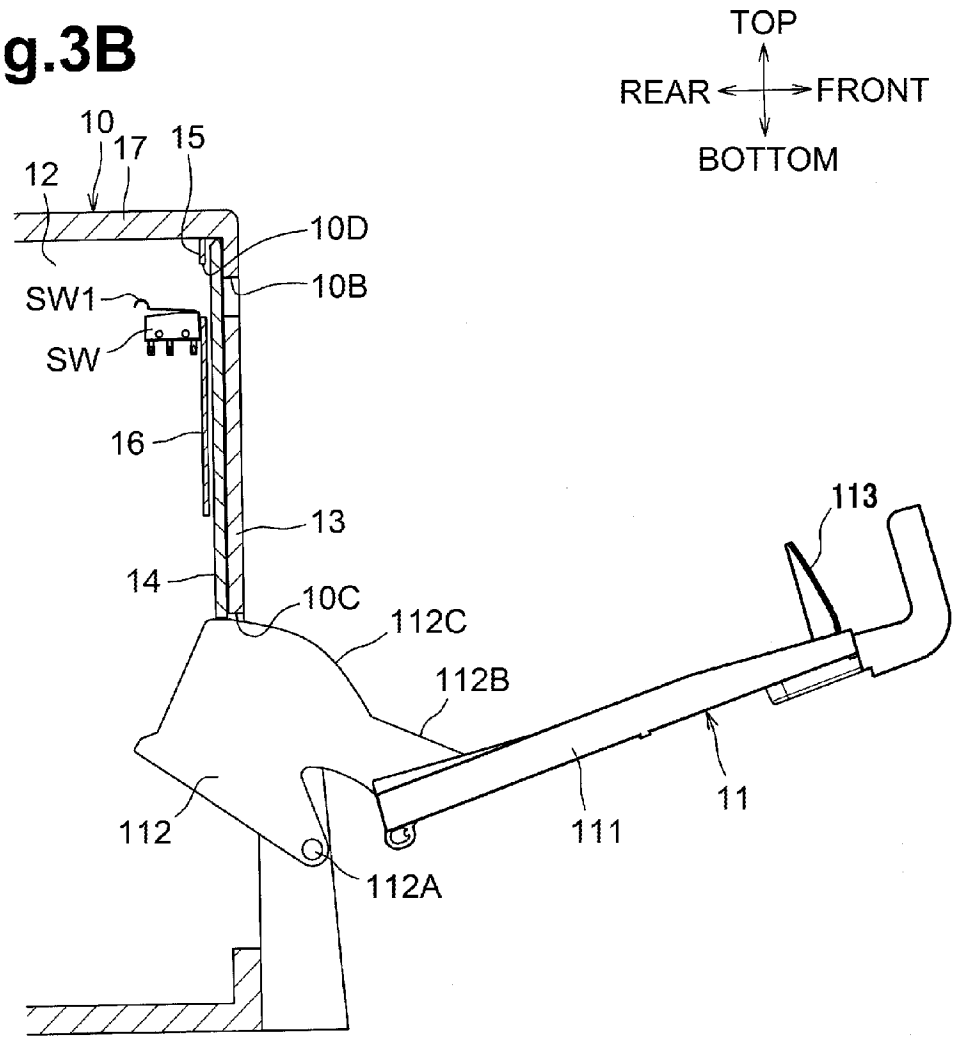
FIG. 3B is a sectional view of the casing, the front cover, the shutter, and the interlock switch when the front cover is open.
Figure 3A:
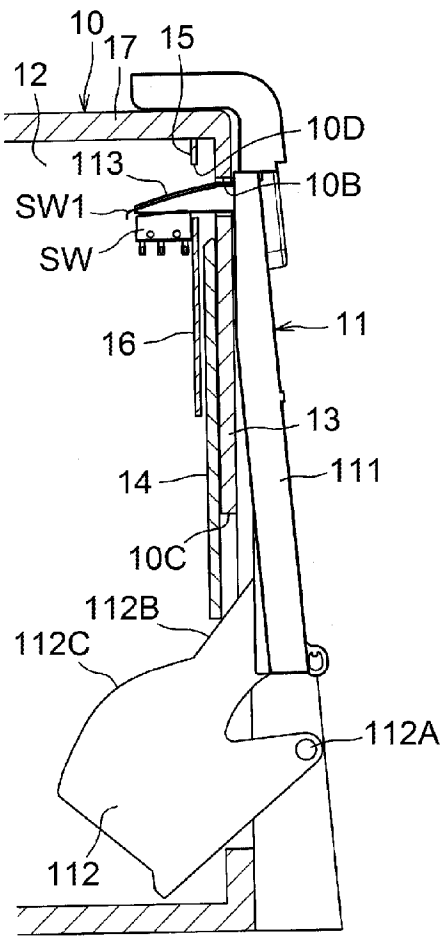
FIG. 3A is a sectional view of the casing, the front cover, a shutter, and an interlock switch when the front cover is closed.

As depicted in FIG. 3A, the interlock switch SW is supported by the side frame 12. The interlock switch SW is disposed behind the front wall 13. The illustrated example of the interlock switch SW includes a lever SW1. The printer 1 is configured to detect that the front cover 11 is closed as the lever SW1 is pressed and that the front cover 11 is open as the pressing of the lever SW1 is released. The interlock switch SW is disposed near the switch opening 10B such that the lever SW1 can be seen from the switch opening 10B when viewed from the front. The casing 10 includes a cover member (not depicted) disposed outside the side frame 12 in the left-right direction. The interlock switch SW is covered with the cover member.

The casing 10 includes a shutter 14 disposed between the front wall 13 and the interlock switch SW, and movement regulating portions, e.g., a first movement regulating wall 15 and a second movement regulating wall 16, disposed on an interlock switch SW-side with respect to the shutter 14, e.g., rearward of or to the rear of the shutter 14. In other words, the first movement regulating wall 15 and the second movement regulating wall 16 are disposed closer to the interlock switch SW than the shutter 14 in the front-rear direction.

The shutter 14 is a plate member configured to move up and down between the front wall 13 and the first and second movement regulating walls 15 and 16. As depicted in FIG. 3B, the shutter 14 is formed longer in the vertical direction than the distance from the upper edge of the opening portion 10C of the front wall 13 to the upper edge of the switch opening 10B. As noted above, the 14 shutter selectively covers switch opening 10B when the cover 11 is open so as to prevent the interlock switch SW from being accessed through the switch opening 10B.

The shutter 14 is configured to move between a shielding position as depicted in FIG. 3B, and a retracted position as depicted in FIG. 3A. In the shielding position, the upper end of the shutter 14 is positioned above the switch opening 10B to shield a portion between the switch opening 10B and the interlock switch SW. In the retracted position, the shutter 14 is retracted downward from the shielding position, and the whole shutter 14 is located below the switch opening 10B.

In the illustrative embodiment, when the shutter 14 is in the shielding position, the upper end of the shutter 14 contacts the upper wall 17 of the casing 10.

The first movement regulating wall 15 and the second movement regulating wall 16 are walls opposing the front wall 13 provided at the left side frame 12. The first movement regulating wall 15 and the second movement regulating wall 16 extend outward in the left-right direction from an outer surface of the left side frame 12.

The first movement regulating wall 15 opposes a portion of the front wall 13 above the switch opening 10B and the lower end of the first movement regulating wall 15 is disposed above the upper end of the switch opening 10B. The second movement regulating wall 16 opposes a portion of the front wall 13 below the switch opening 10B and the upper end of the second movement regulating wall 16 is disposed below the lower end of the switch opening 10B.

In other words, a third opening, e.g., an inner opening 10D, is disposed between the switch opening 10B and the interlock switch SW and between the first movement regulating wall 15 and the second movement regulating wall 16. The switch opening 10B is smaller than the inner opening 10D.

The first movement regulating wall 15 is configured to contact the shutter 14 above the switch opening 10B (e.g., at downstream of the switch opening 10B in a movement direction of the shutter 14 from the retracted position to the shielding position). The second movement regulating wall 16 is configured to contact the shutter 14 below the switch opening 10B (e.g., at upstream of the switch opening 10B in the movement direction of the shutter 14 from the retracted position to the shielding position).

The front cover 11 includes a cover portion 111 configured to overlap with the front wall 13 of the casing 10 when the insertion opening 10A is closed, a pivot portion 112 provided integrally with the cover portion 111 and pivotally supported by the casing 10, and a pressing portion 113 protruding from an inner surface of the cover portion 111.

The pressing portion 113 is a protrusion configured to be inserted into the switch opening 10B and press the interlock switch SW when the front cover 11 is closed. The pressing portion 113 is disposed at a portion of an inner surface of the cover portion 111 corresponding to the switch opening 10B. The pressing portion 113 is formed long enough to reach the lever SW1 of the interlock switch SW through the switch opening 10B and the inner opening 10D, when the front cover 11 is closed.

The pivot portion 112 has such a shape to extend more rearward than the cover portion 111 when the front cover 11 is closed. The pivot portion 112 is inserted into the casing 10 through the opening portion 10C of the front wall 13 when the front cover 11 is closed. The shutter 14 is mounted on a portion of the pivot portion 112 inserted into the casing 10. The pivot portion 112 includes a pivot shaft 112A positioned further toward the front than the front wall 13.

The pivot portion 112 includes a first surface 112B extending slantingly rearward and downward from the cover portion 111 of the front cover 11 when the front cover 11 is closed, and a contact portion, e.g., a second surface 112C, extending slantingly rearward and downward in an arc shape from the lower end of the first surface 112B.

The first surface 112B is a surface on which the shutter 14 is mounted when the front cover 11 is closed. The first surface 112B is formed to position the shutter 14 in the retracted position.

The second surface 112C is provided such that as the second surface 112C extends further away from the cover portion 111 of the front cover 11, the second surface 112C is further away from the pivot shaft 112A. As the front cover 11 is opened, the second surface 112C raises the shutter 14 to move the shutter 14 to the shielding position. When the front cover 11 is in the most open state, the second surface 112C keeps the shutter 14 in the shielding position.

As the pivot portion 112 is thus structured, the pivot portion 112 functions as a linkage mechanism configured to position the shutter 14 in the retracted position when the front cover 11 is closed, and to move the shutter 14 to the shielding position in association with the opening of the front cover 11.

As depicted in FIG. 3B, the upper end of the opening portion 10C formed on the front wall 13 of the casing 10 is disposed at generally the same level as the lower end of the shutter 14 positioned in the shielding position. The front wall 13 covers a portion of the shutter 14 that contacts the second surface 112C of the pivot portion 112 to such an extent that a user is not able to touch.

As depicted in FIG. 3A, when the front cover 11 is closed, the pressing portion 113 presses the lever SW1 of the interlock switch SW. Thus, it may be detected that the front cover 11 is closed.

As the front cover 11 is opened, the pressing portion 113 moves away from the lever SW1, and the interlock switch SW is turned off. Thus, it may be detected that the front cover 11 is open.

As the front cover 11 is further opened as depicted in FIG. 3B, the second surface 112C of the pivot portion 112 raises the shutter 14 to the shielding position. Thus, as the shutter 14 is in the shielding position, the shutter 14 may block a finger of a user or a thin rod mistakenly inserted from the switch opening 10B. Therefore, pressing of the interlock switch SW when the front cover 11 is open may be reduced or prevented.

When the shutter 14 is in the shielding position, the first movement regulating wall 15 and the second movement regulating wall 16 are positioned behind the shutter 14. Therefore, even when the shutter 14 is pressed toward the interlock switch SW, the first movement regulating wall 15 and the second movement regulating wall 16 contact the shutter 14 to prevent or reduce the shutter 14 from moving to the interlock switch SW.

When the shutter 14 is pressed toward the interlock switch SW, the first movement regulating wall 15 contacts the shutter 14 above the switch opening 10B and the second movement regulating wall 16 contacts the shutter 14 below the switch opening 10B. Therefore, the shutter 14 may be prevented or reduced from moving to the interlock switch SW more reliably, as compared with a case in which a movement regulating wall is provided to contact the shutter 14 at one of the sides above or below the switch opening 10B.

When the front cover 11 is open, the front wall 13 covers an upper end portion and a lower end portion of the shutter 14. Therefore, the shutter 14 may be prevented or reduced from being moved as a user touches the shutter 14. In the illustrative embodiment, when the shutter 14 is in the shielding position, the upper end of the shutter 14 contacts the upper wall 17, and the lower end of the shutter 14 contacts the pivot portion 112. Therefore, even if a user should touch the shutter 14, the shutter 14 may be prevented or reduced from being moved from the shielding position.

As depicted in FIG. 3A, as the front cover 11 is closed, the level or position of a surface of the pivot portion 112 contacting the shutter 14 is lowered. Therefore, the shutter 14 moves down by its own weight to the retracted position. Thus, the pressing portion 113 inserted into the switch opening 10B may press the lever SW1 of the interlock switch SW without being blocked by the shutter 14.

[Second Illustrative Embodiment]

Figure 4:
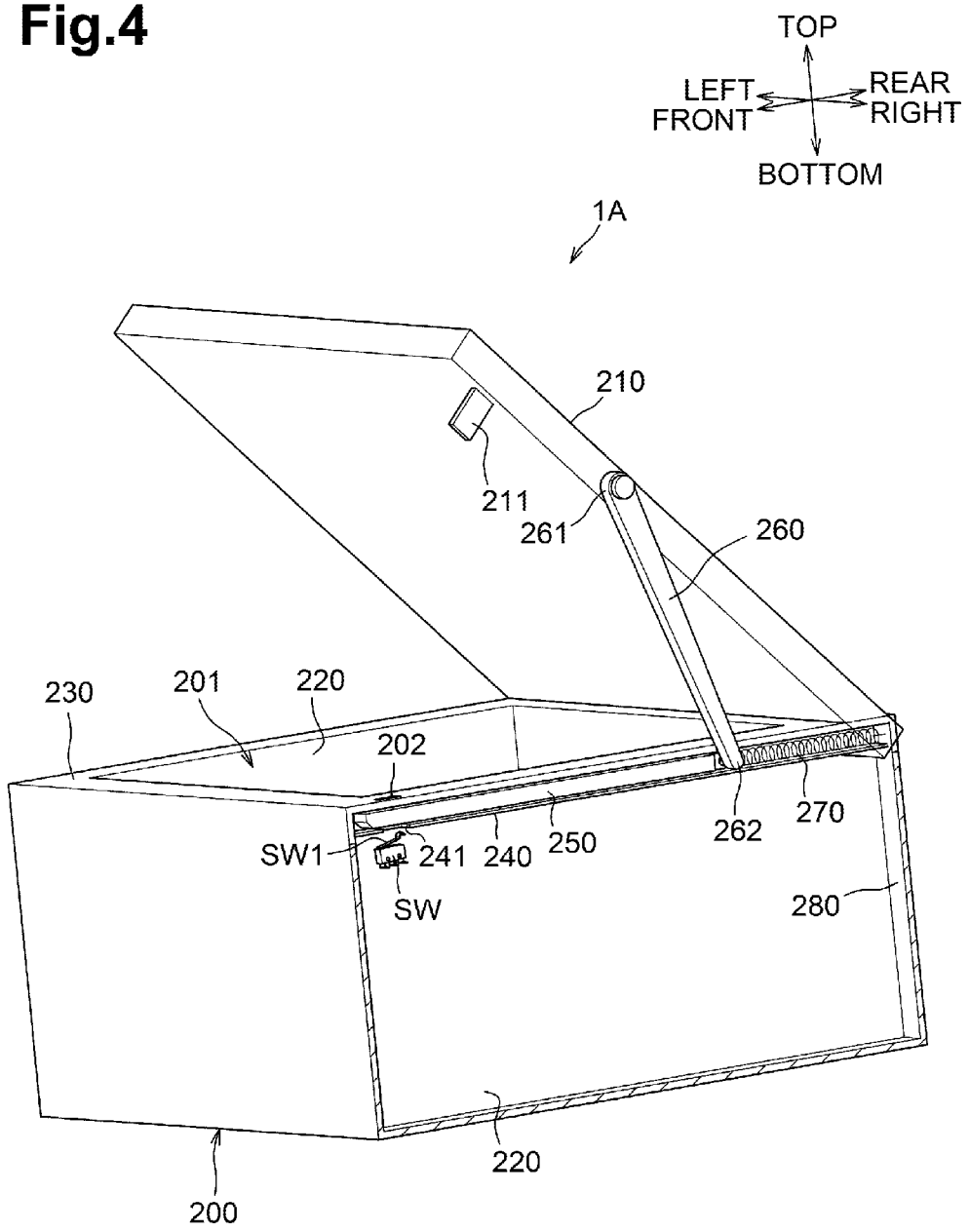
FIG. 4 is a perspective view of a casing with a top cover open in a second illustrative embodiment.

Next, a second illustrative embodiment of the disclosure will be described referring to the accompanying drawings. In a color printer 1A according to the second illustrative embodiment, as depicted in FIG. 4, the process unit U is configured to be attached to or removed from a casing 200 when an opening-and-closing member, e.g., a top cover 210, is open. In the second illustrative embodiment, similar reference numerals will be used to designate elements similar to those discussed in the first illustrative embodiment and detailed description thereof with respect to the second illustrative embodiment will be omitted herein.

The casing 200 includes a frame, a pair of right and left side frames 220, an upper wall 230, and a movement regulating portion, e.g., a movement regulating wall 240, extending parallel to the upper wall 230 from the right side frame 220 outwardly in the left-right direction.

The color printer 1A includes a shutter 250 disposed between the upper wall 230 and the movement regulating wall 240, and a connecting member 260 connecting the shutter 250 and the top cover 210.

A right end portion of the upper wall 230 extends more outward in the left-right direction than the right side frame 220. The portion of the upper wall 230 extending more outward in the left-right direction than the right side frame 220 has a switch opening 202 at a front end portion thereof.

Figure 5A:
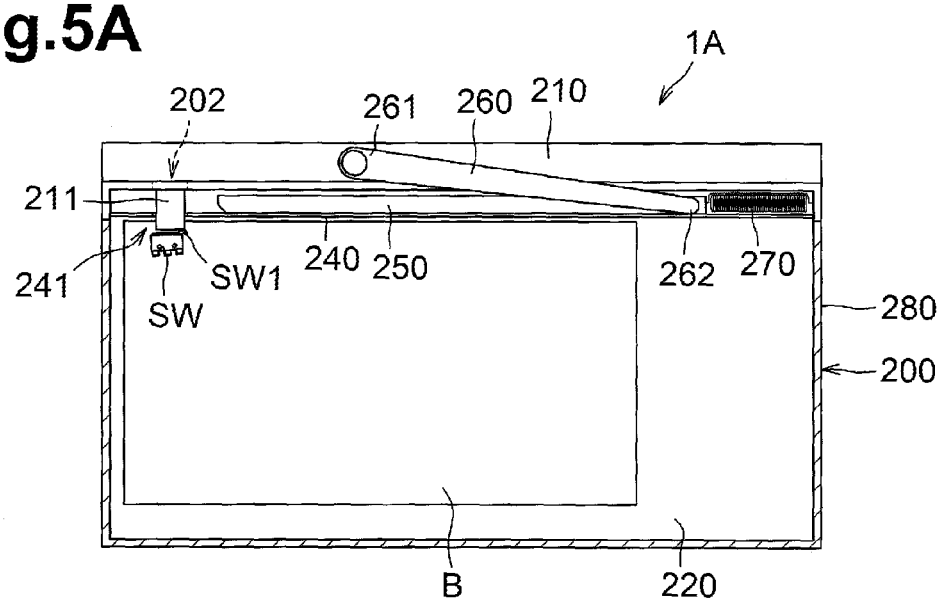
FIG. 5A is a sectional view of the casing, the top cover, a shutter, and an interlock switch when the top cover is closed.

As depicted in FIG. 5A, the right side frame 220 supports a circuit board B on which the interlock switch SW is fixed. The circuit board B is disposed outward of the right side frame 220 in the left-right direction. In other words, the right side frame 220 supports the interlock switch SW via the circuit board B. The interlock switch SW is disposed below the switch opening 202.

The shutter 250 is a rod-like member disposed between the upper wall 230 and the interlock switch SW. The shutter 250 is disposed between the upper wall 230 and the movement regulating wall 240. The shutter 250 is formed bigger than the switch opening 202, e.g., in a size to cover the whole switch opening 202. More specifically, in the second illustrative embodiment, the shutter 250 has a length more than one half of the length of the casing 200 in the front-rear direction.

Figure 5B:
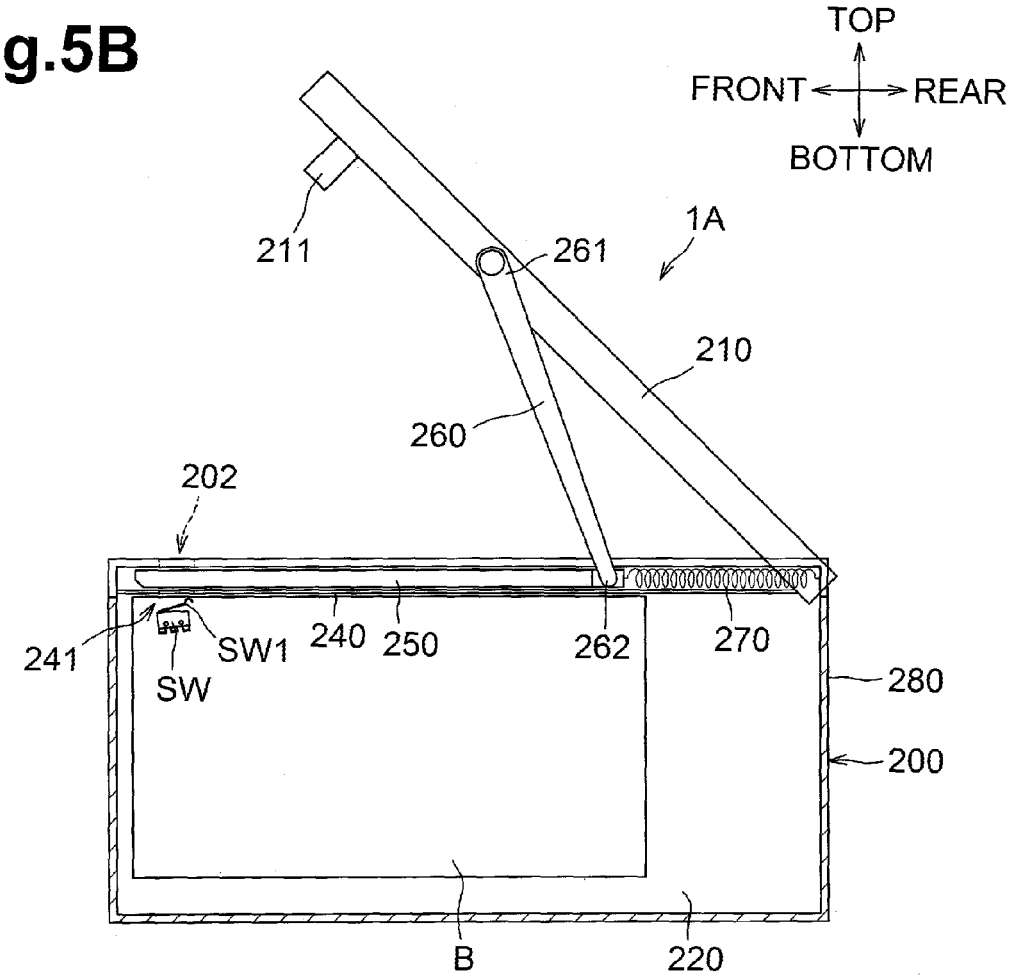
FIG. 5B is a sectional view of the casing, the top cover, the shutter, and the interlock switch when the top cover is open.

The shutter 250 is configured to move back and forth, e.g., frontward and rearward, to a shielding position, as depicted in FIG. 5B, and a retracted position, as depicted in FIG. 5A. In the shielding position, a front end portion of the shutter 250 is disposed between the switch opening 202 and the interlock switch SW to shield the whole switch opening 202. In the retracted position, the shutter 250 is retracted rearward from the shielding position, and the front end of the shutter 250 is positioned more reward than the switch opening 202.

A helical compression spring 270 is disposed between the shutter 250 and a rear wall 280 of the casing 200. The shutter 250 is urged toward the shielding position by the helical compression spring 270.

The movement regulating wall 240 extends from the front end of the side frame 220 to the rear end of the side frame 220 on an interlock switch SW-side with respect to the shutter 250, e.g., below the shutter 250. The movement regulating wall 240 has an inner opening 241 at a position to overlap with the switch opening 202 in the vertical direction. The inner opening 241 is smaller than the switch opening 202. The movement regulating wall 240 contacts the shutter 250 at positions in front of and behind the switch opening 202 when the shutter 250 is pressed toward the interlock switch SW. The movement regulating wall 240 may prevent or reduce the shutter 250 from moving to the interlock switch SW.

As depicted in FIG. 4, the top cover 210 is pivotally provided about a rear end portion of the casing 200. As the top cover 210 is pivotally moved, an insertion opening 201 is opened or closed.

An inner surface of the top cover 210 is provided with a pressing portion 211 protruding from a position corresponding to the switch opening 202. As depicted in FIG. 5A, the pressing portion 211 is formed long enough to press the lever SW1 of the interlock switch SW through the switch opening 202 and the inner opening 241, when the top cover 210 is closed.

The connecting member 260 is a rod-like member. One end 261 of the connecting member 260 is pivotally supported by the top cover 210. An opposite end 262 of the connecting member 260 is pivotally supported by a rear end portion of the shutter 250. The connecting member 260 is configured to move the shutter 250 between the shielding position and the retracted position as the top cover 210 changes its position when opened or closed.

The connecting member 260 is configured to position the opposite end 262 coupled to the shutter 250 closer to the pivot of the top cover 210 than the one end 261 coupled to the top cover 210 when the top cover 210 is open, and to move the opposite end 262 rearward against an urging force of the helical compression spring 270 as the top cover 210 is closed. Thus, the top cover 210 is not slammed or closed fast and furious. When the top cover 210 is open, the connecting member 260 receives such an urging force to open the top cover 210 from the helical compression spring 270. Thus, the top cover 210 is kept open.

The connecting member 260 is configured to move the shutter 250 rearward, e.g., to the retracted position, as the top cover 210 is closed, and move the shutter 250 frontward, e.g., to the shielding position, as the top cover 210 is opened. In other words, the connecting member 260 functions as a linkage member configured to position the shutter 250 to the retracted position when the top cover 210 is closed and to move the shutter 250 to the shielding position in association with the opening of the top cover 210.

As depicted in FIG. 5A, when the top cover 210 is closed, the shutter 250 is in the retracted position, and the pressing portion 211 presses the lever SW1 of the interlock switch SW. As the top cover 210 is opened, the pressing portion 211 moves away from the lever SW1, and the interlock switch SW is turned off.

As the top cover 210 is further opened as depicted in FIG. 5B, the connecting member 260 moves the shutter 250 to the shielding position. Thus, in the second illustrative embodiment, the interlock switch SW may be prevented or reduced from being pressed when the top cover 210 is open.

In the second illustrative embodiment, the connecting member 260 links the top cover 210 and the shutter 250 to move the top cover 210 and the shutter 250 in association with each other. Therefore, for example, when a user tries to move the shutter 250 to the retracted position, the top cover 210 is closed. Thus, the shutter 250 may be prevented from being moved to the retracted position when the top cover 210 is open.

The shutter 250 positioned in the shielding position covers the whole switch opening 202. Therefore, as compared with a case in which a shutter partially covers the switch opening 202, the shutter 250 may be prevented or reduced from being moved through the switch opening 202.

The connecting member 260 moves the shutter 250 to the retracted position as the top cover 210 is closed, as depicted in FIG. 5A. Thus, the pressing portion 211 inserted into the switch opening 202 may press the lever SW1 of the interlock switch SW without being blocked by the shutter 250.

[Third Illustrative Embodiment]

Figure 6:
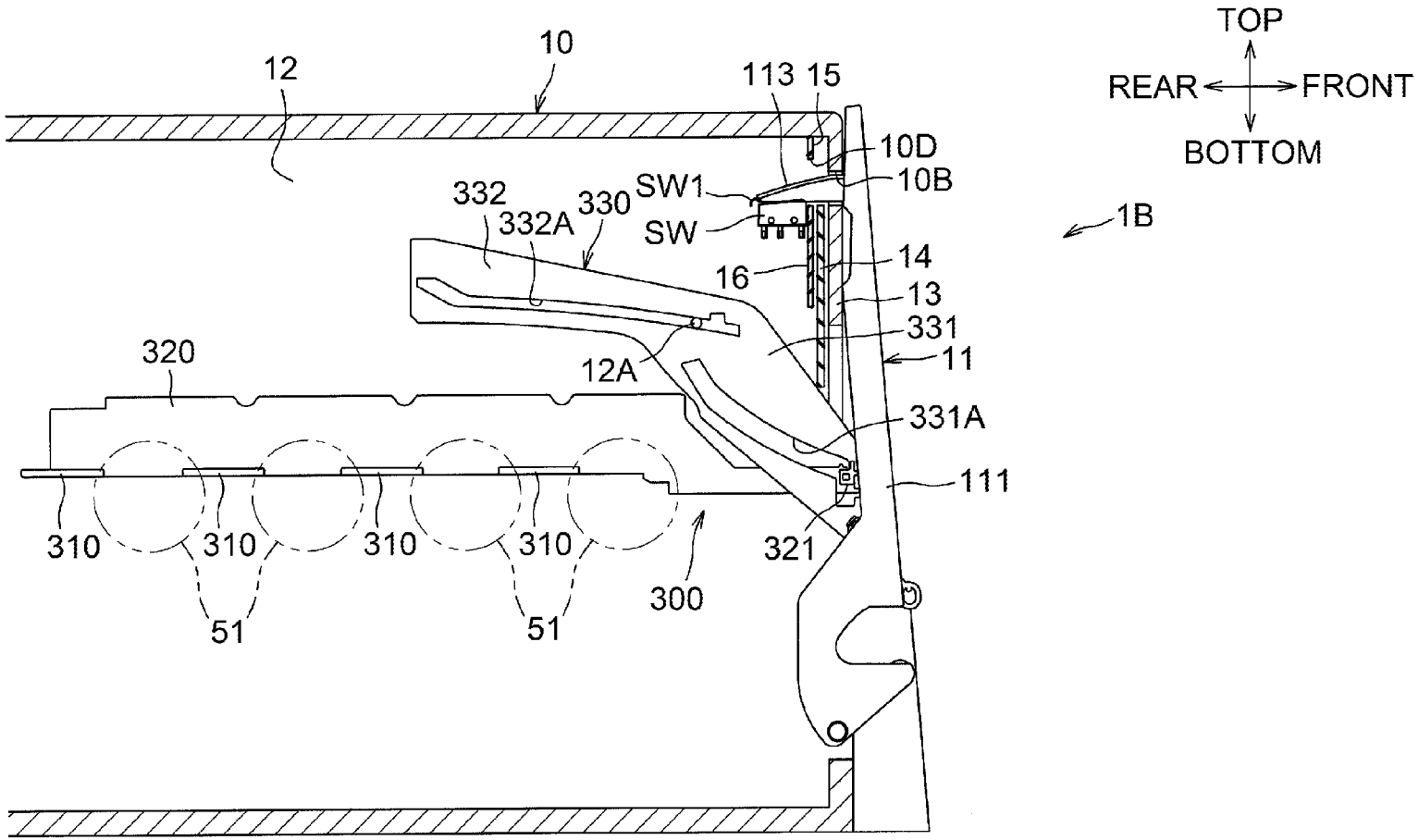
FIG. 6 is a sectional view of the casing, the front cover, the shutter and the interlock switch of a color printer in a third illustrative embodiment, when the front cover is closed.

Next, a third illustrative embodiment will be described with reference to the accompanying drawings. In the third illustrative embodiment, as depicted in FIG. 6, a linkage mechanism, e.g., an acting member 300, configured to move in association with the opening and closing of the front cover 11 moves the shutter 14 between the shielding position and the retracted position. In the third illustrative embodiment, similar reference numerals will be used to designate elements similar to those discussed in the first illustrative embodiment and detailed description thereof with respect to the third illustrative embodiment will be omitted herein.

A color printer 1B includes the acting member 300 configured to act on drive force transmission mechanisms 57 by moving relative to the process unit U in association with the opening and closing of the front cover 11. The drive force transmission mechanism 57 is configured to transmit drive force to the corresponding photosensitive drum 51 of the process unit U.

Figure 7A:
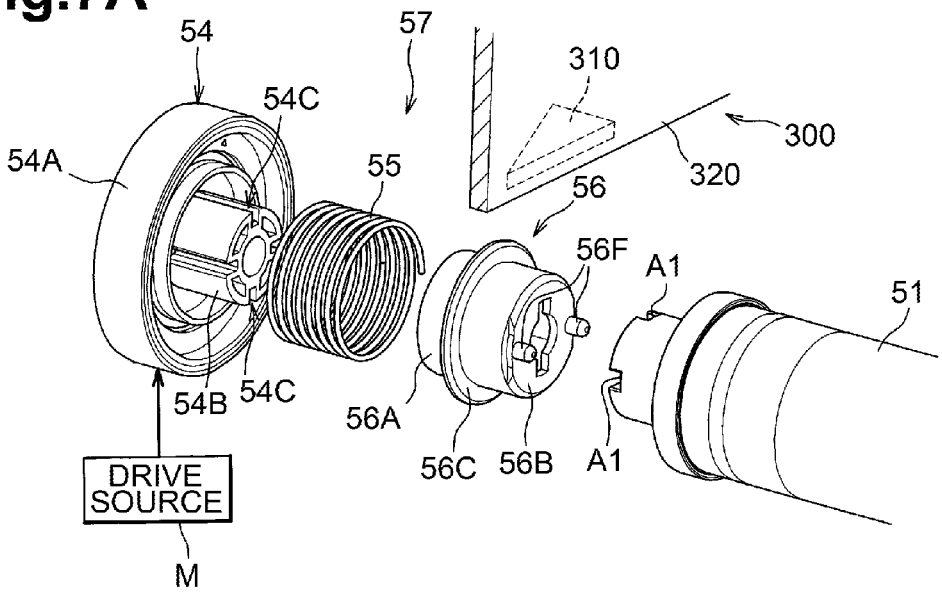
FIGS. 7A and 7B are exploded perspective views of a drive force transmission mechanism and an acting member.
Figure 7B:
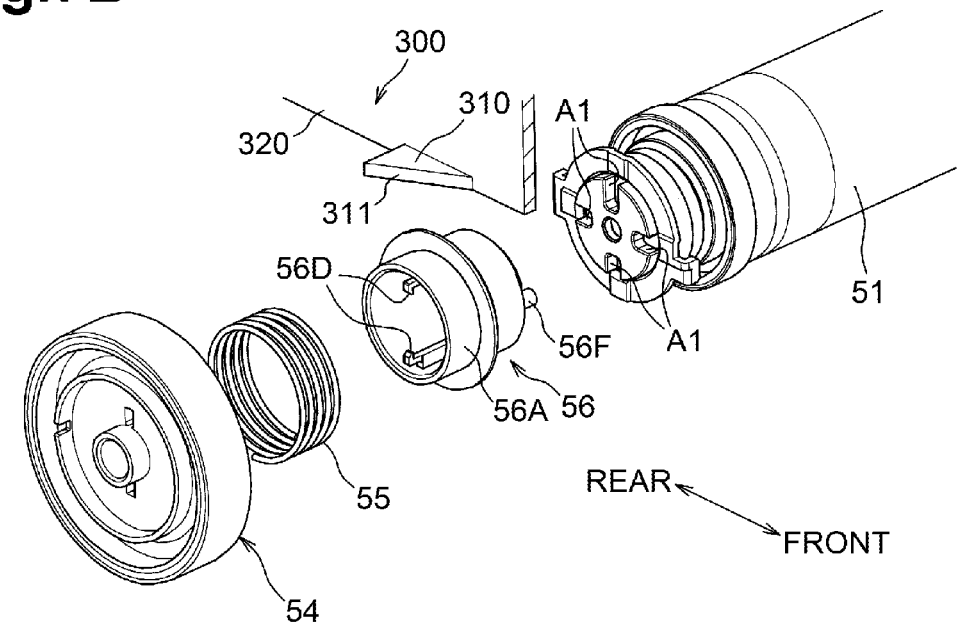

As depicted in FIGS. 7A and 7B, the drive force transmission mechanism 57 includes a drive source M, e.g., a motor, a body driving gear 54 to which the drive force is transmitted from the drive source M, a coupling 56, and a coil spring 55 disposed between the body driving gear 54 and the coupling 56.

The body driving gear 54 is rotatably supported by the casing 10. The body driving gear 54 includes a gear portion 54A configured to rotate as the drive force is transmitted from the drive source M, and a protruding portion 54B protruding from the gear portion 54A toward the coupling 56. A pair of grooves 54C is formed on an outer peripheral surface of the protruding portion 54B so as to extend in the front-rear direction with an axis of the body driving gear 54 interposed therebetween.

The coupling 56 is disposed between the body driving gear 54 and the photosensitive drum 51. The coupling 56 is configured to transmit the drive force from the body driving gear 54 to the photosensitive drum 51 as the coupling 56 engages with the body driving gear 54 and the photosensitive drum 51 in a rotating direction of the photosensitive drum 51.

More specifically, the coupling 56 includes a tubular portion 56A, a bottom wall 56B, an annular flange 56C, a pair of hooks 56D, and a pair of projection 56F. The tubular portion 56A receives the protruding portion 54B of the body driving gear 54. The bottom wall 56B connects to an end face of the tubular portion 56A closer to photosensitive drum 51. The annular flange 56C protrudes from the outer peripheral surface of the tubular portion 56A outward in a radial direction thereof. The hooks 56D protrude from the inner peripheral surface of the tubular portion 56A and extend toward the body driving gear 54 to fit in the corresponding grooves 54C of the body driving gear 54. The projections 56F protrude from the bottom wall 56B toward the photosensitive drum 51. As the hooks 56D fit in the corresponding grooves 54C of the body driving gear 54, the coupling 56 engages the body driving gear 54 in the rotating direction of the photosensitive drum 51.

Four recesses A1 configured to engage the projections 56F of the coupling 56 are formed at an end portion of the photosensitive drum 51. The recesses A1 are shifted by an interval of 90 degrees from each other. The projections 56F and the recesses A1 engage with each other in the rotating direction of the photosensitive drum 51 with a pair of the projections 56F fit in a pair of the recesses A1.

The coil spring 55 is provided in a compressed state between the gear portion 54A of the body driving gear 54 and the flange 56C of the coupling 56. The coil spring 55 urges the coupling 56 toward the photosensitive drum 51.

The acting member 300 is configured to separate the coupling 56 from the photosensitive drum 51 as the coupling 56 is pressed toward the body driving gear 54. As depicted in FIG. 6, the acting member 300 includes positioning members 310, a support plate 320 that supports each of the positioning members 310, and a connecting arm 330 that connects the support plate 320 and the front cover 11.

As depicted in FIG. 7B, the positioning member 310 include an inclined surface 311 that inclines more leftward as the surface 311 extends more rearward. The inclined surface 311 is configured to contact the flange 56C of the coupling 56 in the front-rear direction (e.g., a direction perpendicular to a rotation axis of the photosensitive drum 51).

The support plate 320 is a plate shape member extending in the front-rear direction. The support plate 320 is movably supported by the casing 10 so as to slide in the front and rear direction. As depicted in FIG. 6, the support plate 320 includes an engagement protrusion 321 disposed at a front end portion thereof and protruding toward the connecting arm 330.

The connecting arm 330 is pivotally supported by the front cover 11. The connecting arm 330 includes a first portion 331 extending slantingly rearward and upward from the cover portion 111 with the front cover 11 closed, and a contact portion, e.g., a second portion 332, extending rearward from the first portion 331 with the front cover 11 closed.

The first portion 331 is formed with a first groove 311A extending slantingly rearward and upward from a front end portion of the first portion 331. The first groove 311A engages with the engagement protrusion 321 of the support plate 320. The second portion 332 is formed with a second groove 332A extending rearward from a portion of second portion 332 above the rear end of the first groove 311A. A boss 12A protruding from the side frame 12 of the casing 10 engages in the second groove 332A, so that the position of the connecting arm 330 is determined.

A portion of The connecting arm 330 is disposed below the shutter 14. The connecting arm 330 contacts a lower end portion of the shutter 14. In other words, the shutter 14 is mounted on the connecting arm 330. The connecting arm 330 is configured to position the shutter 14 to the retracted position by contacting the first portion 331 to the shutter 14 when the front cover 11 is closed. As the front cover 11 is opened, the second portion 332 raises the shutter 14 to the shielding position.

As depicted in FIG. 6, as the front cover 11 is closed, the shutter 14 is positioned to the retracted position. Therefore, the pressing portion 113 presses the lever SW1 of the interlock switch SW.

At this time, each positioning member 310 is placed at a position shifted from the corresponding photosensitive drum 51 in the front-rear direction, and does not act on the corresponding coupling 56. Thus, the coupling 56 and the photosensitive drum 51 engage with each other, and the photosensitive drum 51 rotates.

Figure 8:
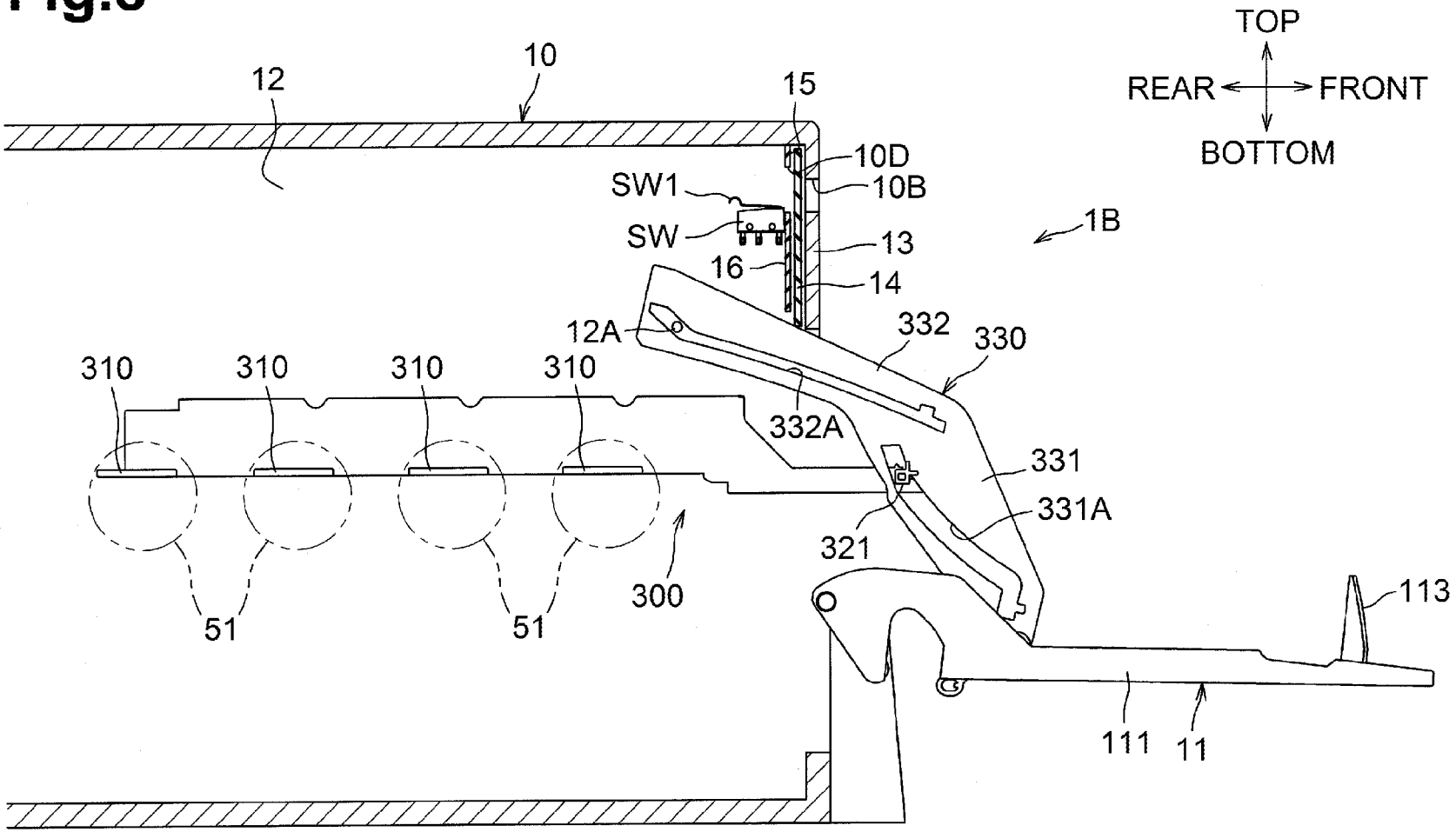
FIG. 8 is a sectional view of the casing, the front cover, the shutter, and the interlock switch when the front cover is open.

As the front cover 11 is opened, as depicted in FIG. 8, the pressing portion 113 moves away from the lever SW1 of the interlock switch SW, and the interlock switch SW is turned off.

At this time, as the connecting arm 330 pivotally moves, the shutter 14 moves to the shielding position. Thus, the shutter 14 blocks the movement of the pressing portion 113 toward the interlock switch SW. Thus, in the third illustrative embodiment, the interlock switch SW may be prevented or reduced from being pressed when the front cover 11 is open.

As the front cover 11 is opened, the connecting arm 330 pivotally moves, so that the support plate 320 is pulled toward the front as the engagement protrusion 321 engages with an edge of the first groove 311A. Thus, each positioning member 310 moves to a position corresponding to the relevant photosensitive drum 51, to separate the coupling 56 from the corresponding photosensitive drum 51. Thus, when the front cover 11 is open, the photosensitive drums 51 do not rotate.

As the front cover 11 is closed, the connecting arm 330 pivotally moves, so that a portion of the connecting arm 330 that contacts the shutter 14 becomes the first portion 331, as depicted in FIG. 6. The shutter 14 is lowered by its own weight to the retracted position. Thus, the pressing portion 113 inserted into the switch opening 10B presses the lever SW1 of the interlock switch SW without being blocked by the shutter 14.

While the disclosure has been described in detail with reference to the specific embodiment thereof, this is merely an example, and various changes, arrangements and modifications may be applied therein without departing from the spirit and scope of the disclosure.

In the illustrative embodiments, the movement regulating portion (the first movement regulating wall 15 and the second movement regulating wall 16 in the first and third illustrative embodiments, and the movement regulating wall 240 in the second illustrative embodiment) is provided at the side frame 12 and 220. However, the structure of the movement regulating portion is not limited thereto. For example, the movement regulating portion may be provided at a cover member configured to cover the side frame.

In the illustrative embodiments, the second opening, e.g., the switch opening 10B and 202, is provided separately from the first opening, e.g., the insertion opening 10A and 201. However, the structures of the first opening and the second opening are not limited thereto. For example, the first opening and the second opening may be connected to form one opening.

In the illustrative embodiment, the color printer 1, 1A and 1B is an example of an image forming apparatus. However, the disclosure is not thereto. For example, the disclosure may be applied to a monochrome laser printers, copiers or multifunction devices.

What is claimed is:

1. An image forming apparatus comprising:

a casing having a first opening and a second opening, the first and second openings each extending between an interior of the casing and an exterior of the casing and through a wall of the casing;

an interlock switch disposed in the casing, wherein the interlock switch is accessible through the second opening;

a cover having a close position in which the cover covers the first opening and the second opening, and an open position in which the cover does not cover the first opening and the second opening;

a shutter having a shielding position in which the shutter covers the second opening, and a retracted position, the shutter being operably connected to the cover so as to move between the shielding position and the retracted position in response to movement of the cover;

a regulating wall spaced apart from the wall of the casing and slidably receiving the shutter; and a protrusion extending from the cover, wherein the protrusion extends through the second opening when the cover is in the close position and the shutter is in the retracted position.

2. The image forming apparatus of claim 1, wherein the shutter is positioned in the retracted position in response to the cover being in the close position, and wherein the shutter is positioned in the shielding position in response to the cover being in the open position.

3. The image forming apparatus of claim 1, wherein the protrusion engages the interlock switch when the cover is in the close position.

4. The image forming apparatus of claim 1, further comprising a linkage member extending from the cover and interacting with the shutter so as to move the shutter to the shielding position in response to the cover being in the open position and to move the shutter to the retracted position in response to the cover being in the close position.

5. The image forming apparatus of claim 4, wherein the linkage member is pivotally connected to the casing, and the cover is pivotally movable between the close position and the open position.

6. The image forming apparatus of claim 4, wherein the linkage member includes a contact portion having a first straight surface contacting the shutter in the retracted position and a second curved surface contacting the shutter in the shielding position.

7. The image forming apparatus of claim 4, wherein the linkage member is pivotally connected to the shutter.

8. The image forming apparatus of claim 1, wherein the regulating wall includes first and second sections positioned on opposing sides of the second opening with respect to a movement direction of the shutter.

9. The image forming apparatus of claim 1, wherein the casing includes a side frame supporting the interlock switch, and wherein the regulating wall extends from the side frame.

10. The image forming apparatus of claim 1, wherein when the shutter is positioned at the shielding position, the shutter entirely covers the second opening.

11. The image forming apparatus of claim 4, wherein the linkage member further comprises;

a contact portion configured to contact the shutter when the cover moves toward the open position, the contact portion disposed in the interior of the casing.

12. The image forming apparatus of claim 4, further comprising;

a process unit disposed in the casing;

wherein the linkage member is connected to the process unit such that the process unit moves in response to movement of the cover.

13. The image forming apparatus of claim 7, further comprising a biasing member acting on the linkage member so as to position the linkage member to hold the cover at the open position.

14. The image forming apparatus of claim 1, wherein the regulating wall defines a third opening, wherein the second opening is smaller than the third opening.

15. The image forming apparatus of claim 4, wherein the linkage member includes a contact portion contacting the shutter, the contact portion being disposed below the regulating wall.

16. An image forming apparatus comprising:

a casing having a first opening and a second opening, the first and second openings each extending between an interior of the casing and an exterior of the casing;

a cover having a close position in which the cover covers the first opening and the second opening, and an open position in which the cover does not cover the first opening and the second opening;

a shutter having a shielding position in which the shutter covers the second opening, and a retracted position, the shutter being operably connected to the cover so as to move between the shielding position and the retracted position in response to movement of the cover;

a protrusion extending from the cover, wherein the protrusion extends through the second opening when the cover is in the close position and the shutter is in the retracted position; and a linkage member extending from the cover and interacting with the shutter so as to move the shutter to the shielding position in response to the cover being in the open position and to move the shutter to the retracted position in response to the cover being in the close position, the linkage member includes a contact portion having a first straight surface contacting the shutter in the retracted position and a second curved surface contacting the shutter in the shielding position.

17. An image forming apparatus comprising:

a casing having a first opening and a second opening, the first and second openings each extending between an interior of the casing and an exterior of the casing;

a cover having a close position in which the cover covers the first opening and the second opening, and an open position in which the cover does not cover the first opening and the second opening;

a shutter having a shielding position in which the shutter covers the second opening, and a retracted position, the shutter being operably connected to the cover so as to move between the shielding position and the retracted position in response to movement of the cover;

a protrusion extending from the cover, wherein the protrusion extends through the second opening when the cover is in the close position and the shutter is in the retracted position; and a linkage member extending from the cover and pivotally connected to the shutter so as to move the shutter to the shielding position in response to the cover being in the open position and to move the shutter to the retracted position in response to the cover being in the close position.

18. An image forming apparatus comprising:

a casing having a first opening and a second opening, the first and second openings each extending between an interior of the casing and an exterior of the casing;

a process unit disposed in the casing;

a cover having a close position in which the cover covers the first opening and the second opening, and an open position in which the cover does not cover the first opening and the second opening;

a shutter having a shielding position in which the shutter covers the second opening, and a retracted position, the shutter being operably connected to the cover so as to move between the shielding position and the retracted position in response to movement of the cover;

a protrusion extending from the cover, wherein the protrusion extends through the second opening when the cover is in the close position and the shutter is it the retracted position; and a linkage member extending from the cover and interacting with the shutter so as to move the shutter to the shielding position in response to the cover being in the open position and to move the shutter to the retracted position in response to the cover being in the close position;

wherein the linkage member is connected to the process unit such that the process unit moves in response to the movement of the cover.

19. The image forming apparatus of the claim 18, further comprising;

a drive source; and a coupling configured to transmit a drive force from the drive source to the process unit;

wherein the linkage member presses the coupling toward the process unit when the cover is in the close position and the shutter is in the retracted position.

* * * * *